US006659748B1

(12) United States Patent
Arbogast et al.

(10) Patent No.: US 6,659,748 B1
(45) Date of Patent: Dec. 9, 2003

(54) AXIAL COMPENSATION IN AN INNER GEARED PUMP FOR A CLOSED CIRCUIT

(75) Inventors: Franz Arbogast, Heidenheim (DE); Günther Nagel, Steinheim (DE)

(73) Assignee: Voith Turbo GmbH & Co. KG, Heidenheim (DE)

( * ) Notice: Subject to any disclaimer, the term of this patent is extended or adjusted under 35 U.S.C. 154(b) by 0 days.

(21) Appl. No.: 10/019,796

(22) PCT Filed: Jul. 5, 2000

(86) PCT No.: PCT/EP00/06341

§ 371 (c)(1),
(2), (4) Date: Apr. 30, 2002

(87) PCT Pub. No.: WO01/02729

PCT Pub. Date: Jan. 11, 2001

(30) Foreign Application Priority Data

Jul. 6, 1999 (DE) ..... 199 30 911

(51) Int. Cl.[7] ..... F01C 1/10
(52) U.S. Cl. ..... 418/126; 132/170
(58) Field of Search ..... 418/126, 132, 418/169, 170

(56) References Cited

U.S. PATENT DOCUMENTS

| | | | | | |
|---|---|---|---|---|---|
| 3,525,581 | A | * | 8/1970 | Eckerle | 418/126 |
| 4,132,514 | A | * | 1/1979 | Eckerle | 418/126 |
| 4,472,123 | A | * | 9/1984 | Eckerle et al. | 418/126 |
| 5,299,923 | A | * | 4/1994 | Arbogast et al. | 418/169 |
| 5,354,188 | A | | 10/1994 | Arbogast et al. | 418/132 |

FOREIGN PATENT DOCUMENTS

| | | | | |
|---|---|---|---|---|
| DE | 353 838 | | 9/1922 | |
| DE | 2 114 872 | | 10/1972 | |
| DE | 43 38 875 | | 5/1995 | |
| EP | 0 563 661 | | 3/1993 | |
| JP | 55-014964 | | 2/1980 | |
| JP | 55-35105 | * | 3/1980 | 418/126 |

OTHER PUBLICATIONS

German Office Action dated Nov. 15, 2000 in German Application No. 199 30 911.6 and English language translation of same.

* cited by examiner

*Primary Examiner*—John J. Vrablik
(74) *Attorney, Agent, or Firm*—Baker & Daniels

(57) ABSTRACT

An internal geared machine capable of forward and reverse operation in a closed circuit having a pinion and an internal toothed ring gear meshing with the pinion and disposed in a housing. A filling comprising two identical filler pieces fills a sickle-shaped space between the pinion and ring gear and a single stop pin mounted in the housing supports both of the filler pieces by their front ends. A pair of axial discs are seated on the pinion shaft on respective sides of the pinion and axial pressure fields and control fields provide opposing pressures against the axial discs.

16 Claims, 4 Drawing Sheets

AXIAL COMPENSATION IN AN INNER GEARED PUMP FOR A CLOSED CIRCUIT

The invention relates to an internal geared machine, especially an internal geared pump. Such machines are known from numerous publications, for example EP 0 563 661 A1 and its counterpart. U.S. Pat. No. 5,354,188, which is incorporated by reference herein.

Said pump has axially moving discs, so-called axial discs bordering on the rotating toothed parts of the internal toothed ring gear and the pinion. Said axial discs are movable in axial direction. They are pressed against the rotating toothed parts by means of an axial pressure derived from the working pressure so as to compensate the gap between the housing and the toothed part.

With frequency converters a constant displacement pump can be turned into a variable capacity pump by means of speed control. Such a pump has considerable advantages over a variable piston pump. The noise level during operation is much lower, it has a longer service life and uses less energy.

Problems always arise when machines of the above described type have to operate in reverse and when the pressure range changes. For example, there are numerous applications where it is desirable to have an internal geared pump operating both clockwise and counterclockwise. So far, no solution has been found for the cases where such a pump has to operate in a closed circuit.

For high pressure applications an axial compensation is also required. Both axial pressure surfaces of said axial discs are pressurized at the same time. The side connected with high pressure is pressurized with high pressure and the other side is pressurized with the feeder pressure, which is approx. 10 bar.

The invention is discussed in more detail by means of the drawing showing the following:

FIG. 4 again shows an axial sectional view of a section of a second version of an internal geared pump.

Figure 3:
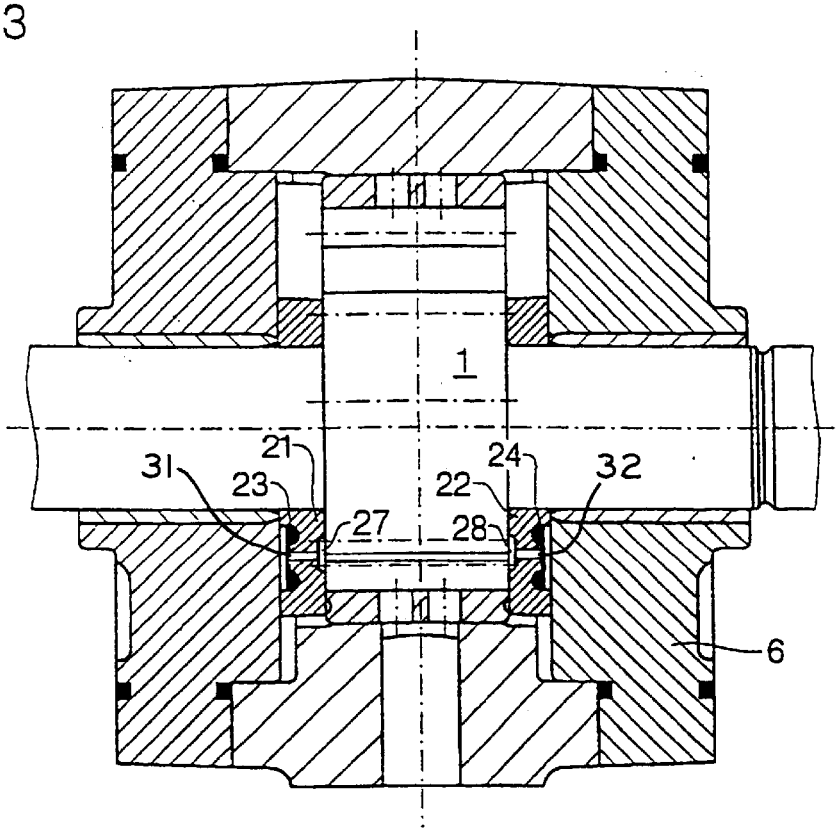
FIG. 3 shows an axial sectional view of a section of a first version of an internal geared pump.
Figure 4:
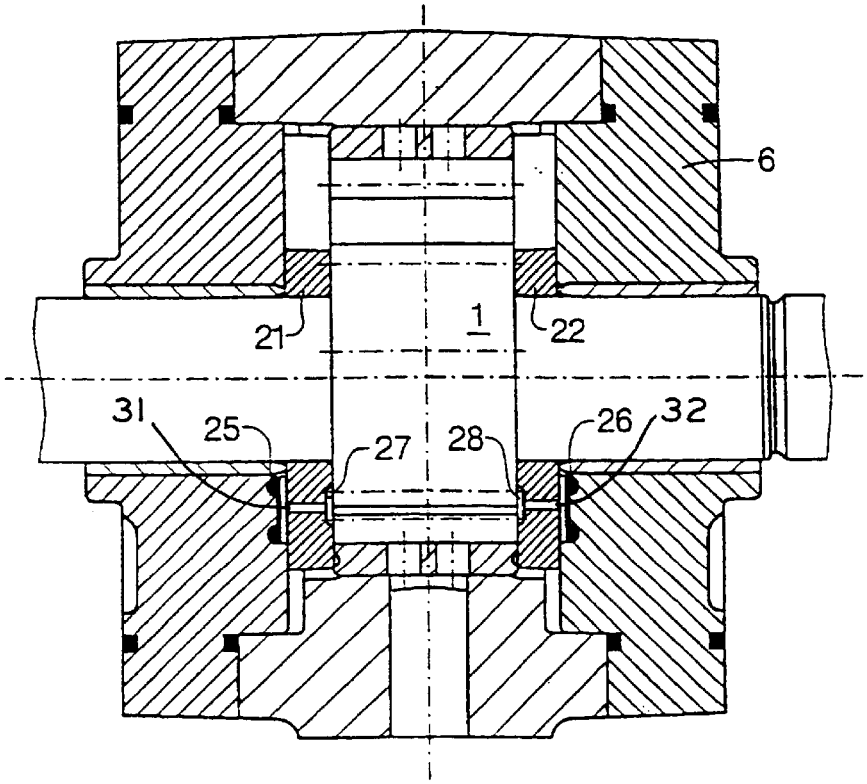
Figure 5:
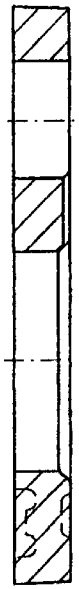

FIG. 5 shows an axial disc in an axial sectional view in accordance with the illustrations in FIGS. 3 and 4.

Figure 6:
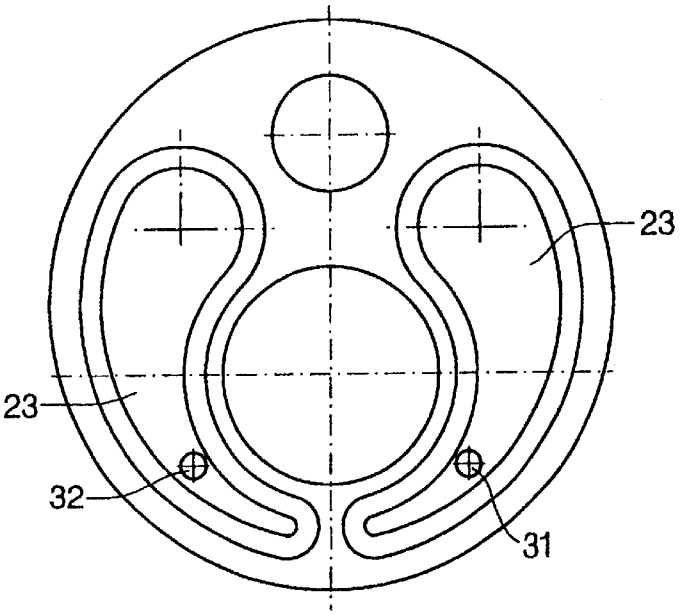

FIG. 6 is a top view of the left surface of the axial disc of FIG. 5.

Figure 7:
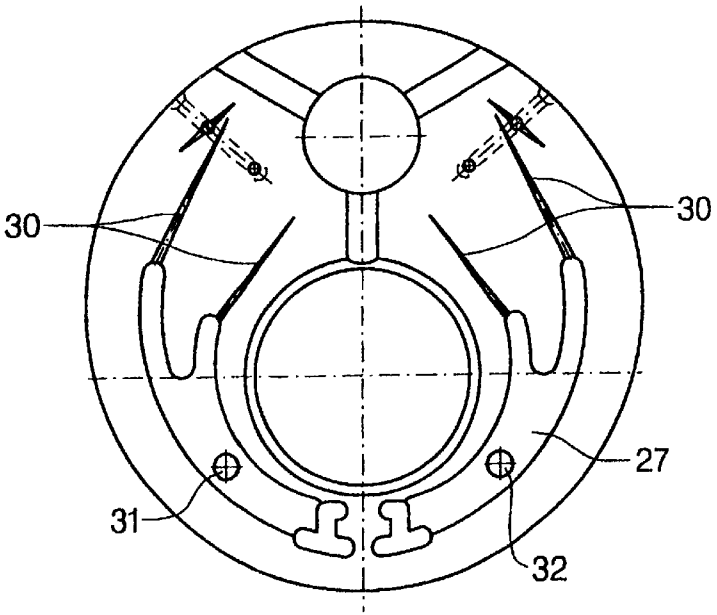

FIG. 7 is a top view of the right surface of the axial disc of FIG. 5.

Figure 1:
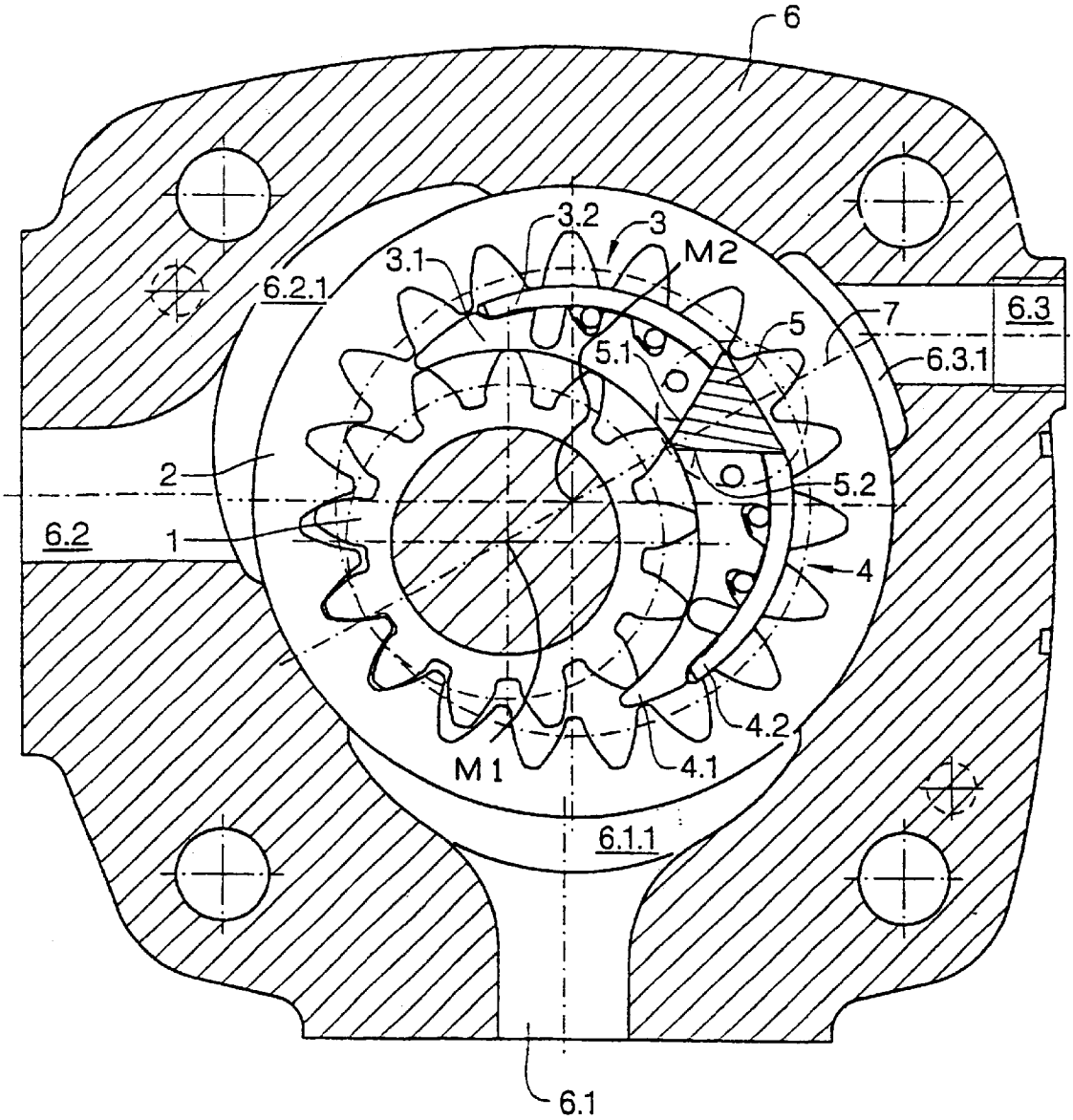
FIG. 1 shows an axial-vertical sectional view of an internal geared pump.

The internal geared pump shown in FIG. 1 comprises the following substantial components: an external toothed pinion 1, an internal toothed ring gear 2, a filling consisting of two filler pieces 3, 4, a stop pin 5 and a housing 6.

The pinion 1 is seated eccentrically relative to the ring gear 2. See center M1 of the pinion and center M2 of the ring gear. A straight line in a dot-and-dash pattern is applied through the two centers M1 and M2. Said line defines a plane of symmetry whose relevance will be discussed below.

The sickle-shaped space between the pinion 1 and the ring gear 2 is filled with a filling. Said filling comprises the two filler pieces 3, 4. The stop pin 5 is mounted in the housing 6 and has a certain play. The illustration shows that the stop pin has two supporting surfaces 5.1, 5.2. The front ends of the two filler pieces 3, 4 are supported against the supporting surfaces 5.1, 5.2.

Furthermore, the two filler pieces 3, 4 are longitudinally divided in a manner known in the art. Therefore, they are based on an inside part 3.1, 3.2 and 4.1, 4.2, respectively, but each filler piece 3, 4 could just as well consist of one single part.

The housing has two pressure connections 6.1, 6.2. The two pressure connections are provided on both sides of the plane of symmetry 7. The housing also has a leakage outlet 6.3 which, in this case, is located precisely on the plane of symmetry 7.

In detail, FIGS. 3 and 4 show the following: Axial discs 21, 22 are provided between the two walls of the housing 6 and the pinion 1. In the first version as per FIG. 3, axial pressure fields 23, 24 are incorporated directly in the axial pressure discs 21, 22. As is well known and disclosed in the aforementioned U.S. Pat. No. 5,354,188, the pressure fields bear on the walls of housing 6 and press axial discs 20, 21 against gears 1 and 2.

In the second version as per FIG. 4, the axial fields 25, 26 are incorporated in the walls of the housing 6.

Said axial pressure fields are also seen in FIG. 6 where they are shown as axial pressure fields 23.

The axial discs 21, 22 are provided with control fields 27, 28 on their inner sides, i.e. on the sides facing the pinion 1. Again, as disclosed in U.S. Pat. No. 5,354,188, control fields 27 and 28 apply pressure on discs 21 and 22 that oppose pressure fields 23 and 24. Also see FIG. 7. According to the invention, the control fields 27, 28 have a special feature: they are provided with slots. See slots 30 in FIG. 7. The arrangement is such that the recesses formed by the slots 30 are in communication with the recesses formed by the control fields 27, 28. Through-bores 31, 32 are also provided to enable the pressure medium coming from the internal gear pump to enter the spaces on the opposite sides of discs 21 and 22 to create the pressure fields. See FIGS. 6 and 7.

Note the symmetrical configuration with regard to the axial pressure fields, the control fields and the control slots. The control slots 30 are configured such that the volume of the recesses they are forming increases starting from the tip of each control slot toward the control field. As a result, the pressure is building relatively slowly in the control fields so as to prevent excessive wear or even damage to the machine.

Between the axial pressure fields 23, 24 and the respective walls of the housing 6, or between the axial pressure fields 25, 26 and the axial discs 21, 22 a so-called axial piston can be provided, which substantially has the same shape as the respective control field 23 shown in FIG. 6.

Figure 2:
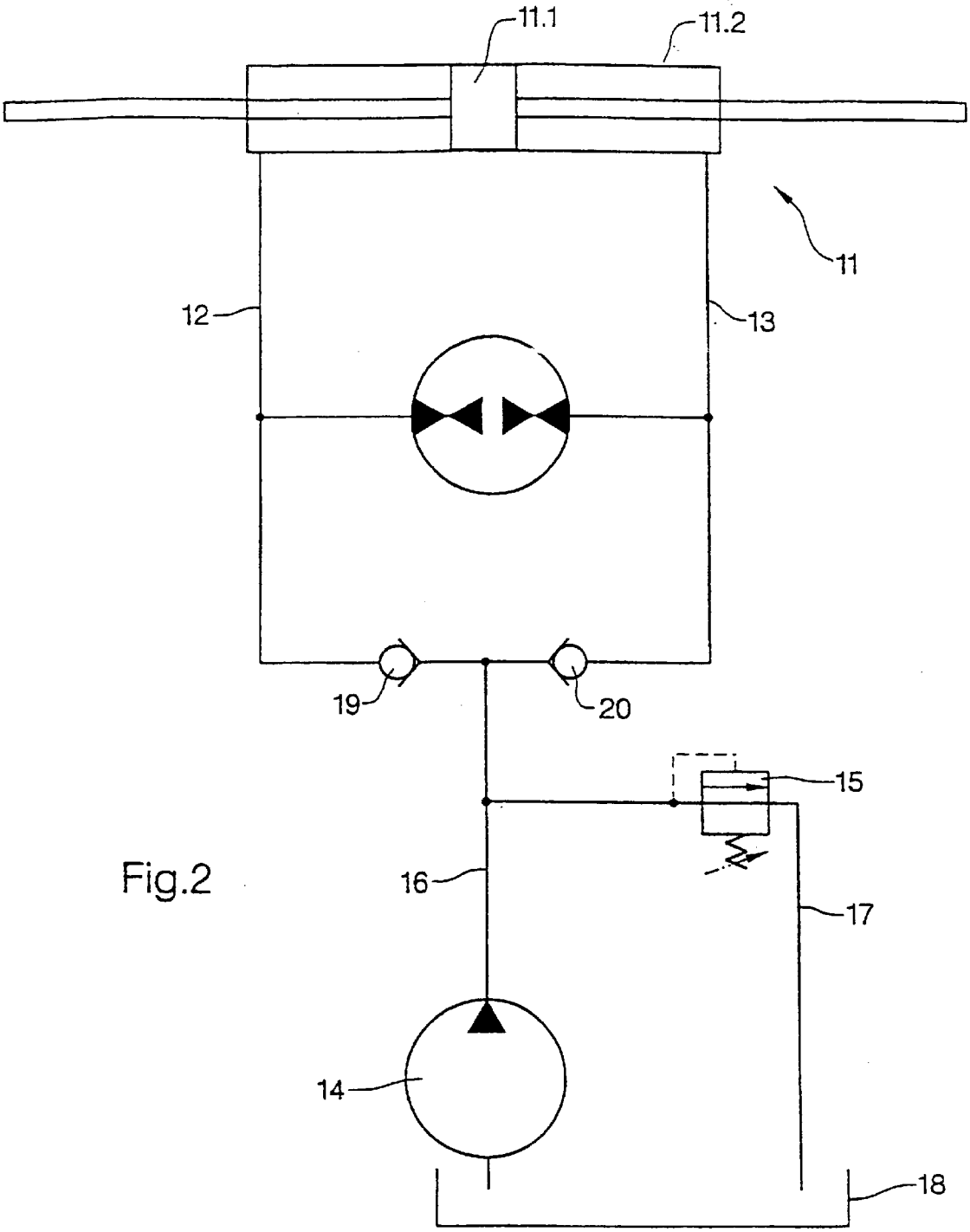
FIG. 2 shows a circuit with an internal geared pump of the invention.

FIG. 2 illustrates internal geared pump 14 in an exemplary enclosed circuit arrangement to drive reversible piston 11.1 disposed in cylinder 11.2. The input of pump 14 is connected to sump 18 and the output 16 connected through check valves 19 and 20 in lines 12 and 13 to power hydraulic device 11. Pressure relief valve 15 is connected in the return line 17 to sump 18.

We claim:

1. Internal geared machine for forward and reverse operation in a closed circuit, comprising:

a housing;

an external toothed pinion and an internal toothed ring gear meshing with said pinion, said pinion and ring gear being disposed in said housing;

a filling that fills a sickle-shaped space between said pinion and ring gear, said filling comprising two identical filler pieces;

a single stop pin mounted in said housing, both of said filler pieces supported by their front ends against said single stop pin;

a pinion shaft joined to said pinion;

a pair of axial discs seated on said shaft on respective sides of said pinion;

axial pressure fields provided between each said axial disc and said housing;

control fields provided between each said axial disc and said pinion; and control slots connected to the control fields.

2. Internal geared machine according to claim 1, characterized in that the machine is a component of a closed circuit.

3. Internal geared machine according to claim 1, characterized in that the housing is provided with two pressure connections and a leakage outlet.

4. Internal geared machine according to claim 1, characterized by the following:

the filler pieces are disposed symmetrically to a plane of symmetry that extends through the centers of the pinion and the ring gear;

the two pressure connections are located on both sides of the plane of symmetry as seen in axial direction.

5. Internal geared machine according to claim 1, characterized in that the machine is a component of a closed circuit.

6. Internal geared machine according to claim 1, characterized in that the control slots are tapering in the direction of their free ends starting at the control fields.

7. Internal geared machine according to claim 6, characterized in that the housing is provided with two pressure connections and a leakage outlet.

8. Internal geared machine according to claim 6, characterized by the following:

the filler pieces are disposed symmetrically to a plane of symmetry that extends through the centers of the pinion and the ring gear;

the two pressure connections are located on both sides of the plane of symmetry as seen in axial direction.

9. Internal geared machine according to claim 6, characterized in that the machine is a component of a closed circuit.

10. Internal geared machine according to claim 1, characterized in that the housing is provided with two pressure connections and a leakage outlet.

11. Internal geared machine according to claim 10, characterized by the following:

the filler pieces are disposed symmetrically to a plane of symmetry that extends through the centers of the pinion and the ring gear;

the two pressure connections are located on both sides of the plane of symmetry as seen in axial direction.

12. Internal geared machine according to claim 10, characterized in that the machine is a component of a closed circuit.

13. Internal geared machine according to claim 1, characterized by the following:

the filler pieces are disposed symmetrically to a plane of symmetry that extends through the centers of the pinion and the ring gear;

the two pressure connections are located on both sides of the plane of symmetry as seen in axial direction.

14. Internal geared machine according to claim 13, characterized in that the machine is a component of a closed circuit.

15. Internal geared machine according to claim 13, characterized in that a leakage outlet is disposed at least approximately on the plane of symmetry.

16. Internal geared machine according to claim 15, characterized in that the machine is a component of a closed circuit.

* * * * *